United States Patent [19]

Mackey

[11] Patent Number: 5,040,270

[45] Date of Patent: Aug. 20, 1991

[54] METHOD AND APPARATUS FOR TREATING FIBROUS MATERIAL

[75] Inventor: James H. Mackey, Corcoran, Calif.

[73] Assignee: J. G. Boswell Company, Corcoran, Calif.

[21] Appl. No.: 536,304

[22] Filed: Jun. 11, 1990

[51] Int. Cl.[5] ..... D01G 9/00; D01G 37/00

[52] U.S. Cl. ..... 19/66 R

[58] Field of Search ..... 19/66 R, 66 CC, 127

[56] References Cited

U.S. PATENT DOCUMENTS

| | | | |
|---|---|---|---|
| 2,867,851 | 1/1959 | Mitchell et al. | 19/66 CC |
| 2,932,857 | 4/1960 | Smith | 19/0.27 |
| 3,357,061 | 12/1967 | Jackson | 19/0.27 |

*Primary Examiner*—Werner H. Schroeder
*Assistant Examiner*—John J. Calvert
*Attorney, Agent, or Firm*—Worrel & Worrel

[57] ABSTRACT

A method for treating fibrous material containing matter to be separated therefrom, the method including the steps of passing fibrous material containing the matter and having a given temperature along a path of travel in a fluid stream; and directing a jet of fluid, having a temperature substantially greater than that of the fibrous material and matter, onto the fibrous material and matter to release the matter from the fibrous material.

An apparatus for treating fibrous material containing matter to be separated, the apparatus having a housing with a path of fluid movement therethrough; a system for passing fibrous material containing the matter to be separated along the path through the housing; and a system for discharging a gas, having a temperature substantially greater than that of the fibrous material and matter, onto the fibrous material and matter during passing thereof along the path to release the matter from the fibrous material.

22 Claims, 2 Drawing Sheets

METHOD AND APPARATUS FOR TREATING FIBROUS MATERIAL

BACKGROUND OF THE INVENTION

1. Field of the Invention

The present invention relates to a method and apparatus for treating fibrous material and more particularly to such a method and apparatus which have particular utility in pretreating fibrous material such as cotton fiber for the more effective removal of foreign matter therefrom without damage to the fiber and without capture of minute particles of the foreign matter within the fiber as experienced with conventional methods and apparatuses.

2. Description of the Prior Art

The manufacture of finished products using natural and synthetic fibers involves a multiplicity of steps. In the case of natural fibers, these steps are directed toward converting the natural fiber from its native state into a fabric from which the finished product can be manufactured. With natural fibers such as cotton, wool, and the like, the fiber must first be harvested and then processed for the removal of foreign matter prior to being further processed and woven into fabric.

Cotton fiber, for example, is first harvested using mechanical harvesters which employ mechanical picking heads to extract the cotton fiber from the bolls of the plants and collect it for subsequent processing. The picking heads typically employ rotary members mounting a multiplicity of spindles and doffers which ensnare and remove cotton from the bolls of the plants passing in relative motion through the picking head. However, this process also pulls seed from the bolls with the cotton fiber. Furthermore, the operation inherently crushes other portions of the cotton plant causing fragments of leaves, bolls, seeds, stems, dirt and other foreign matter to become entrapped in the cotton fiber during the harvesting operation. This foreign matter is known as "trash" and the cotton fiber containing such trash is known as "seed cotton" or untreated cotton. Thus, the seed cotton is collected in the harvester with such trash intimately associated therewith.

Subsequent to such harvesting, present practice calls for the seed cotton to be deposited in a device known as a "module maker" which compresses the seed cotton into a large block known as a "cotton module". The cotton module ultimately is delivered to a cotton gin for the removal of the trash from the cotton fiber and thereafter for compression of the ginned cotton into cotton bales. The ginning of seed cotton for removal of the seed and other trash is a process which has been known, in at least rudimentary forms, for about two hundred (200) years. A plethora of specific ginning processes have been developed more efficiently and dependably to remove trash from the cotton fiber. Notwithstanding the lengthy period of development of technology directed to this specific purpose, a number of problems continue to plague ginning operations which have not satisfactorily been overcome. In a multiplicity of specific embodiments, it has been known to apply heat, moisture, and mechanical manipulation to the cotton fiber in an effort to extract the trash therefrom. However, such conventional processes have had to operate in an environment in which competing considerations required a compromise of the objectives involved. As a relative matter, the more the cotton fiber is processed, the more trash is removed therefrom. Conversely, the more the cotton fiber is processed, the more damage is done to the fiber itself and the more intimately entrapped in the cotton fiber become finely divided particles of the trash. Present technology calls for an exceedingly complex and expensive series of steps in the ginning of the cotton fiber in an effort to balance these considerations more closely to achieve the desired result. However, even the most successful conventional processes have failed to resolve these problems.

Therefore, it has long been known that it would be desirable to have a method and apparatus for treating fibrous material which has application to a wide variety of both natural and synthetic fibers, which is operable to permit removal of foreign matter from the fiber without damage to the fiber and without more intimately entrapping foreign matter within the fiber, which has application to a wide variety of conventional processes adapted to achieve specific operational goals, and which can be installed and operated without considerable adaptation and expense.

SUMMARY OF THE INVENTION

Therefore, it is an object of the present invention to provide an improved method and apparatus for treating fibrous material.

Another object is to provide such a method and apparatus which cooperate dependably to remove a higher percentage of foreign matter from fibrous material such as cotton than has heretofore been possible while avoiding damage to the fiber itself.

Another object is to provide such a method and apparatus which are particularly well suited to the removal of foreign matter, commonly known as "trash", from cotton fiber and which handle the cotton fiber in such a fashion that the trash is not inextricably capture within the matrix of the fiber.

Another object is to provide such a method and apparatus which operate to pretreat fibrous material and the foreign matter therewithin so as to dissipate the natural adhesion between the fibrous material and the foreign matter.

Another object is to provide such a method and apparatus which can be employed to pretreat the intermixed cotton fiber and trash prior to the ginning operation so that the conventional steps in the ginning operation can be preformed more successfully to remove the trash from the cotton fiber.

Another object is to provide such a method and apparatus which can be utilized in virtually any conventional ginning operation at one or more points throughout the ginning operation so as more successfully to achieve removal of the trash from the cotton fiber being fully compatible with such conventional ginning processes and equipment.

Another object is to provide such a method and apparatus which can be installed and operated in conventional cotton gins and the like to achieve their most effective result at nominal expense.

Another object is to provide such a method and apparatus which can be employed in the ginning of cotton fiber more efficiently and immediately to remove trash from the cotton fiber so that fewer steps are required in the ginning process to achieve a substantially enhanced result over conventional practice without in any way detracting from the ginning operation.

Another object is to provide such a method and apparatus which can be employed to produce a higher grade of cotton fiber than has heretofore been possible.

Further objects and advantages are to provide improved elements and arrangements thereof in an apparatus for the purpose described which is dependable, economical, durable and fully effective in accomplishing its intended purpose.

These and other objects and advantages are achieved in the preferred embodiment of the method and apparatus of the present invention by passing fibrous material containing matter to be separated therefrom and having a given temperature along a path of travel and a fluid stream; and directing a jet of fluid, having a temperature substantially greater than that of the fibrous material and matter, against the fibrous material and matter to release the matter from the fibrous material.

DESCRIPTION OF THE PREFERRED EMBODIMENT

Figure 1:
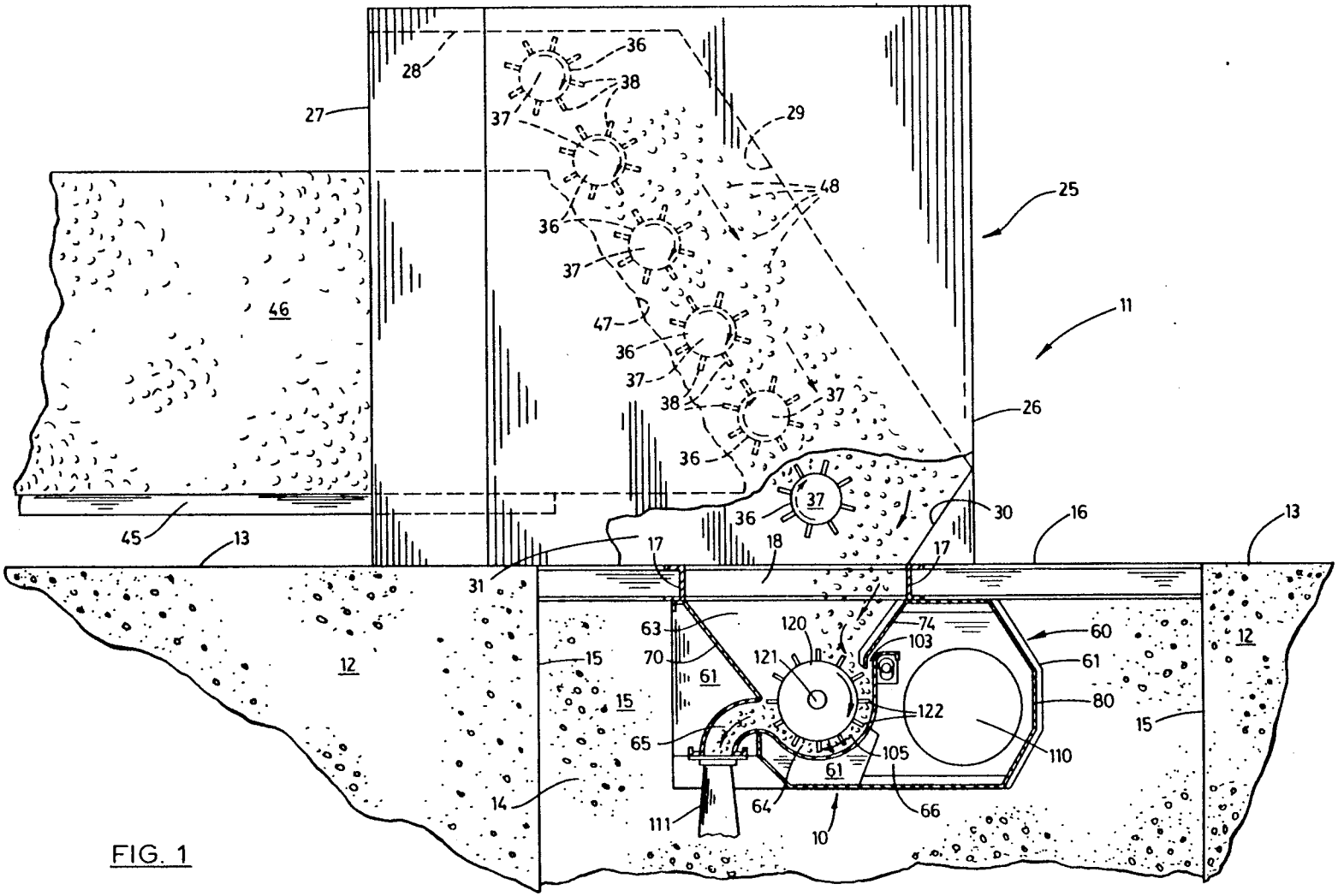
FIG. 1 is a fragmentary vertical section showing the apparatus for treating fibrous material of the present invention for practicing the method hereof shown in a typical operative environment beneath a module feeder in a cotton gin.

Referring more particularly to the drawings, the apparatus for treating fibrous material of the present invention is generally indicated by the numeral 10 in FIG. 1. The apparatus is shown in FIG. 1 in a typical operative environment where it is employed in the treating of seed cotton for the removal of trash therefrom. It will be understood that the method and apparatus of the present invention have application to the treating of fibrous material of the wide variety of types, both naturally occurring and synthetic, for the removal of foreign substances therefrom.

As shown in FIG. 1, a cotton gin 11 has a concrete foundation 12 having a concrete floor 13. A pit 14 is formed in the concrete foundation bounded by concrete walls 15. Suspended on the concrete walls are main support beams 16 interconnected by cross beams 17. Two of the cross beams 17 define a passage 18 therebetween leading into the pit 14.

Mounted on the concrete floor 13, main support beam 16 and cross beam 17 above the passage 18 is a module feeder 25. Module feeders are conventional devices which are employed to receive untreated cotton compressed to form cotton modules and to break the seed cotton therefrom on a continuous, gradual basis so that the seed cotton is delivered into the cotton gin in a free flowing and therefore more easily processed form. The module feeder 25 has a main housing 26 with an entrance 27 facing to the left, as viewed in FIG. 1. The entrance 27 is defined by an upper internal wall 28 leading to an oblique internal wall 29 and to a lower internal wall 30. The entrance 27, upper internal wall 28, oblique internal wall 29 and lower internal wall 30 define an internal chamber 31 for the housing of the module feeder.

Mounted within the internal chamber 31 of the module feeder 25 is a plurality of doffers 36. The doffers are individually adapted for rotation about individual axes of rotation disposed substantially parallel to each other and arranged in a plane substantially parallel to the oblique internal wall 29, as shown in FIG. 1. Each of the doffers consists of a doffer cylinder 37 mounting a plurality of doffer spikes 38. The module feeder operates in the conventional fashion to rotate the doffer cylinders about their individual axes of rotation.

The cotton gin 11 has a moving floor 45 upon which is rested untreated cotton in the form of a cotton module 46. The cotton module has a leading surface 47 and is, in accordance with conventional practice, progressively fed by the moving floor 45 against the doffers 36 which break away cotton fiber intermixed with trash 48 from the cotton module. The cotton fiber 48 is delivered by gravity and the application of vacuum pressure downwardly in the module feeder and out the bottom thereof through the passage 18.

The structure of the cotton gin 11 heretofore described is essentially conventional. In such a conventional cotton gin, the cotton fiber 48, having passed through the passage 18, is delivered by vacuum pressure along ducting, not shown, into the cotton gin for ginning. The apparatus 10 of the present invention is, in accordance with the method and apparatus hereof, mounted in position in place of such ducting.

The apparatus 10 has a main housing 60 mounted in the pit 14 beneath the passage 18 in receiving relation to the cotton fiber 48. The main housing has flange plates 61 which are disposed for facing engagement with the concrete walls 15 and through which bolts 62 are extended and into the concrete walls to mount the housing 60, and thus the apparatus 10, in the operational position shown in FIGS. 1 and 2.

The main housing 60 has a receiving trough 63 disposed in receiving relation to the passage 18 and extending downwardly in converging relation therefrom and from the cross beams 17 to a cylinder chamber 64 leading to a discharge passage 65. The main housing has a hot air chamber 66. These portions of the main housing are defined by a forward wall 70 composed of a trough portion 71 and a lower discharge duct portion 72. The discharge duct portion of the front wall has a duct mounting flange 73 at the lower end thereof. The main housing has a rearward wall 74 which extends downwardly from the cross beam 17 on the right as viewed in FIGS. 1 and 2 in converging relation upon the trough portion 71 and to a curved lower lip 75 immediately above the cylinder chamber 64.

Figure 2:
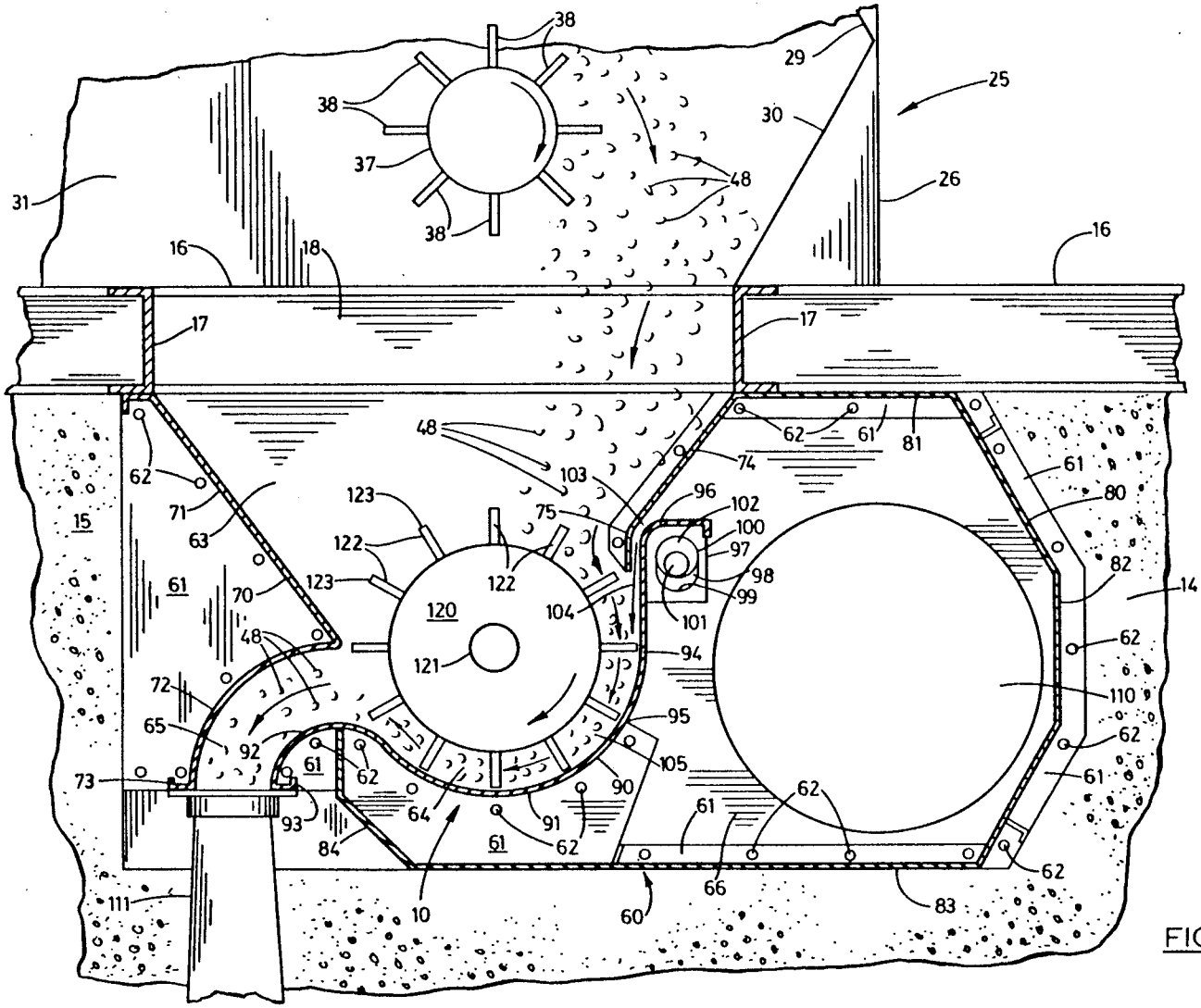
FIG. 2 is a somewhat enlarged, fragmentary vertical section of the apparatus of FIG. 1.

The hot air chamber 66 is housed within the main housing 60 by a hot air plenum 80 constituting part of the main housing. The hot air plenum is defined by an upper wall 81 connected to the upper edge of the rearward wall 74 and extending rearwardly therefrom along the under side of the main support beams 16. The hot air plenum has a rearward wall 82 extending downwardly from the upper wall and communicating at its lower edge with a lower wall 83. The hot air plenum has a forward wall 84 extending from the lower wall to a position roughly in alignment with the lower edge of the trough portion 71 of the forward wall 70, as best shown in FIG. 2.

The main housing 60 has a cylinder chamber wall 90 composed of a main arcuate portion 91 constituting the lower boundary of the cylinder chamber 64. The cylinder chamber wall includes a forward arcuate portion 92 which is connected to the forward wall 84 extending in concentric relation to the discharge duct portion 72 of the forward wall 70 to a rearwardly facing duct mounting flange 93. It will be understood that the main housing has opposite lateral walls disposed in spaced, substantially parallel relation to each other and interconnected by the walls heretofore described extending in substantially normal relation therebetween. The walls of the main housing thus form a substantially airtight housing.

The cylinder chamber wall 90 has an adjustable portion 94 extending upwardly from the main arcuate portion 91 for adjustment, as will hereinafter be described, from a pivot line 95 extending transversely of the main housing 60. The adjustable portion 94 has an upper curved portion 96 conforming to the curved lower lip 75 of the rearward wall 74 and extending rearwardly therefrom. The opposite lateral ends of the adjustable portion 94 and upper curved portion 96 individually mount adjustment plates 97 individually disposed in slidably facing relation to the opposite lateral walls of the housing 60. Each of the adjustment plates has an opening 98 therein bounded by oval cam surfaces 99 and aligned along an axis substantially parallel to the adjustable portion 94 of the cylinder chamber wall 90. An eccentric 100 extends through and interconnects the openings 98 of the adjustment plates. The eccentric includes a shaft 101 mounting a cam lobe 102 within each opening 98. The eccentric 100 is positioned by any suitable manual or mechanical mechanism, not shown, externally of the main housing 60. Thus, by such adjustment of the eccentric 100, the adjustment portion 94 and the upper curved portion 96 thereof can be moved toward or from the curved lower lip 75 of the rearward wall 74. The area between the curved lower lip 75 and the upper curved portion 96 and adjustable portion 94 constitutes a nozzle or a throat 103 adjustable as to area by the eccentric 100 in the manner heretofore described. As will hereinafter be described, the throat 103 passes a jet of heated air along a path indicated by arrow 104 into the cylinder chamber 64. The area immediately bounded by the cylinder chamber wall 90 extending from the curved lower lip 75 to the duct mounting flange 93 constitutes a separation zone 105.

A suitable source of heated air, not shown, is connected to the main housing 60 at a hot air inlet 110 which communicates directly with the hot air plenum 80. The source of heated air can be, for example, a heater and blower unit preferably capable of forcing air heated to a temperature such as to produce a jet of heated air at the throat 103 having a temperature of substantially about 210 degrees Fahrenheit at a velocity of substantially about eight (8) thousand feet per minute to about twelve (12) thousand feet per minute. The heater and blower unit is preferably adjustable as to both temperature and velocity. A discharge duct 111 is mounted on the duct mounting flanges 73 and 93 and extends into the operative portion of the cotton gin 11 for processing of the cotton fiber passing therethrough.

A cylindrical drum 120 is mounted in the cylinder chamber 64 of the main housing 60 extending transversely thereof substantially concentric to the cylinder chamber wall 90 and between the opposite lateral walls of the main housing. The cylindrical drum is mounted for rotational movement on a main shaft 121 and is driven by any suitable drive mechanism, not shown. Preferably, although not necessarily, the drive mechanism is operable to rotate the main shaft and the cylindrical drum borne thereby throughout a range of rotational velocities. The preferred range of velocities includes from forty (40) revolutions to eighty (80) revolutions per minute.

The cylindrical drum 120 mounts a plurality of pins or spikes 122 positioned substantially evenly upon the cylindrical drum extending in radial extension therefrom to terminal ends 123. As can be seen in FIGS. 1 and 2, the terminal ends 123 extend into juxtaposition to the cylinder chamber wall 90 when passing thereby. The spikes are preferably steel and of cylindrical configuration having smooth outer surfaces and being of approximately 2½ inches to 3 inches in length. Preferably, although not necessarily, the spikes are arranged in what is known as a "chevron pattern" on the cylindrical drum. Within this chevron pattern one-half of the surface of the cylindrical drum has spikes arranged in a helical pattern operable to urge cotton toward one end of the cylindrical drum and the other half of the surface of the cylindrical drum has spikes arranged in a helical pattern operable to urge cotton toward the opposite end of the cylindrical drum.

OPERATION

The operation of the described embodiment of the present invention is believed to be readily apparent and is briefly summarized at this point.

As previously noted, the method and apparatus of the present invention have application to a wide variety of operative environments, but are described herein in a typical operative environment in the cotton gin 11. The cotton gin 11 operates in the normal fashion wherein the cotton module 46 of untreated cotton is fed by the moving floor 45 into the internal chamber 31 of the module feeder 25 and against the doffers 36 thereof. The doffers are rotated to break away cotton fiber from the leading surface 47 of the cotton module. The cotton fiber intermixed with trash 48 then is passed by gravitational and vacuumatic attraction downwardly from the internal chamber 31 of the module feeder and through the passage 18.

The untreated cotton consisting of cotton fiber intermixed with trash 48 passes into the receiving trough 63 of the main housing 60 wherein it is contacted by the cylindrical drum 120 and the radial spikes 122 thereof rotating in a clockwise direction as shown in FIGS. 1 and 2. The cylindrical drum is rotated at a relatively slow speed, that being substantially about forty (40) revolutions to about eighty (80) revolutions per minute. Normally for untreated cotton of average or normal moisture content, the speed of rotation of the cylindrical drum is preferably about eighty (80) revolutions per minute. However, where the moisture content of the untreated cotton is greater, the speed of rotation of the cylindrical drum may preferably be less and perhaps as low as forty (40) revolutions per minute depending upon the specific moisture content. The relationship is such that the slower the speed of rotation, the longer the exposure of the cotton fiber and trash to the heated air since movement of the cotton fiber and trash is further retarded thereby.

At this time the eccentric 100 is adjusted so that the thickness of the throat 103 is somewhere in the range of from one-eighth (⅛) of an inch to one (1) inch to produce the jet desired. The source of heated air directs heated air through the hot air inlet 110 to the hot air plenum 80 at a velocity such that the heated air is discharged through the throat 103 at a velocity of substantially about eight (8) thousand feet per minute to about twelve (12) thousand feet per minute. Preferably the temperature of the heated air supplied is such that the temperature of the heated air at the throat 103 is substantially about 210 degrees Fahrenheit. The heated air is discharged along the path indicated by arrow 104 through the cylinder chamber 64 and into the discharge duct 111 through the discharge passage 65. Because of the vacuum applied to the apparatus by the discharge duct 111 and the high velocity jet of heated air passing along the path indicated by arrow 104, the natural velocity of the cotton fiber intermixed with trash 48 would be relatively great. However, the cylindrical drum 120 and the spikes 122 thereof retard such passage of the cotton fiber intermixed with trash so that the heated air is passed through and about the cottom fiber and trash at great velocity causing the cotton fiber to attenuate. It has been discovered that this "slippage" of the heated air passed the cotton fiber and trash prior to passage of the cotton fiber and trash into the gin greatly facilitates drying and removal of the trash by normal ginning procedures while eliminating the complex and expensive drying towers employed in conventional gins. It is believed that such slippage of heated air passed the cotton fiber and the trash causes the moisture within the trash and cotton fiber to flash from the outer surfaces of the cottom fiber and trash, or conversely, to be forced inwardly of the cotton fiber and trash from the outer surfaces thereof. In any case, the moisture content in the outer surfaces of the cotton fiber and trash is temporarily substantially reduced. Over time, moisture beneath the outer surfaces will be absorbed into those outer surfaces to again establish a certain uniformity. However, this takes time and in the meantime the outer surfaces of the cotton fiber and trash retain substantially reduced moisture content.

In any case, this operation breaks the surface adhesion caused by the moisture in the outer layers of cotton fiber and trash thereby freeing the trash for removal from the cotton fiber with significantly less ginning than has heretofore been possible employing conventional technology. Similarly, since this adhesion is temporarily effectively removed, the trash is free to fall from or be released outwardly by virtue of such forces as gravity, centrifugal force and the like which would otherwise not be sufficient to overcome the adhesive character of the surface tension of the moisture within the outer surfaces of the cotton fiber and trash.

Since the trash is thereby free to be released from the cotton fiber during the ginning operation, the aggressive application of forces to the cotton fiber itself characteristic of conventional ginning technology is not required and therefore is not performed. As a consequence, the natural and preferred character of the cotton fiber is preserved through the ginning operation. Still further, since the aggressive manipulation of the cotton fiber is not required in the ginning operation in order to release the trash, the trash is not ground into the cotton fiber during the ginning operation so as to become intimately and inextricably captured within the fiber as occurs in conventional processes. Thus, a higher grade of cotton fiber is produced simultaneously with a greater removal of trash therefrom all with significantly less ginning. Therefore, the expensive and complex equipment required in conventional ginning operations is obviated while simultaneously producing a better a result.

As previously noted, the method and apparatus of the present invention are compatible with virtually all types of ginning operations. Similarly, the method and apparatus can be adapted to the particular ginning process employed and to the desired result. Thus, a plurality of the apparatuses 10 can be employed in a practice of the method in staged sequence and at any desired points throughout the ginning operation. Since the application of the heated air in passage at high velocity through and about the cotton fiber and trash achieves the desired result, a variety of variations can be employed in the method and apparatus to achieve the desired result. As can best be seen upon reference to FIG. 2, the hot air plenum 80 can be so configured as to apply and maintain the temperature conducive to the elimination of the adhesion previously referred to by extension of the hot air plenum further along the path of the movement of the cotton fiber and trash. The hot air plenum can be seen in FIG. 2 to extend entirely about the cylinder chamber wall 90. Since the heated air is employed to pressurize the interior of the hot air plenum, the heat is transferred through the cylindrical chamber wall 90 entirely about the cylinder chamber 64. If desired, the hot air plenum can be extended further along the path of movement of the cotton fiber and trash, or, conversely, a shorter distance along the path of movement of the cotton fiber and trash. In the embodiment of the apparatus of the present invention shown in FIGS. 1 and 2, it has been found that if the temperature of the heated air at the throat 103 is 210 degrees Fahrenheit, the temperature of the heated air by the time it reaches the discharge duct 111 is about 150 degrees Fahrenheit.

Therefore, the method and apparatus for treating fibrous material of the present invention permits a more effective and dependable removal of foreign matter from fibrous material such as cotton than has heretofore been possible in the art, substantially enhances the effectiveness of conventional ginning techniques so as to eliminate the need for the complex methods and apparatuses required in conventional ginning techniques, preserve the natural character of the fibrous material through the process of removing such foreign matter therefrom by eliminating the need for aggressive manipulation of the fibrous material for the removal of the foreign matter, avoids the inextricable intermixing of minute particles of foreign matter within the fibrous material which characterizes conventional techniques, and is otherwise fully effective in achieving the desired result of producing natural and synthetic fibrous material substantially free of foreign matter and in an operation which is substantially less expensive and more dependable than heretofore achieved in the art.

Although the invention has been herein shown and described in what is conceived to be the most practical and preferred embodiment, it is recognized that departures may be made therefrom within the scope of the invention which is not to be limited to the illustrative details disclosed.

Having described my invention, what I claim as new and desired to secure by Letters Patent is:

1. A method for treating fibrous material containing matter to be separated therefrom, the method comprising the steps of passing fibrous material containing said matter and having a given temperature along a path of travel in a fluid stream; and directing a jet of fluid onto the fibrous material and matter wherein said jet of fluid has a temperature sufficiently greater than said given temperature of the fibrous material containing said matter to release matter from the fibrous material.

2. The method of claim 1 including imparting resistance to the fibrous material in said fluid stream to attenuate the fibrous material.

3. The method of claim 2 wherein, in said passing the fibrous material containing said matter is passed at a given velocity and wherein, in said directing, the jet of fluid is directed onto said fibrous material and matter at a velocity substantially greater than said given velocity of said fibrous material in said fluid stream as a result of said resistance imparted thereto.

4. The method of claim 1 wherein said fibrous material and matter have a moisture content extending to outer surfaces thereof and, in said directing, the temperature of said jet of fluid is sufficiently great to reduce the moisture content at said outer surfaces to reduce the adhesion between the fibrous material and the matter caused by the moisture content at said outer surfaces thereof.

5. The method of claim 2 wherein said imparting is performed by a member rotated at a velocity less than the velocity of the jet of fluid in said directing and the member has portions engageable with said fibrous material and matter to impart said resistance thereto in the fluid stream.

6. The method of claim 5 wherein said member in said imparting is rotated at a velocity of substantially about 80 revolutions per minute and said jet of fluid in said directing is directed onto said fibrous material and matter at a velocity of substantially about eight (8) thousand to twelve (12) thousand feet per minute.

7. The method of claim 5 wherein, in said directing, said jet is directed substantially tangentially to said member and onto the fibrous material and matter.

8. The method of claim 4 including the step of applying greater temperature to the fluid stream after said directing for a period substantially to maintain said reduced moisture content in the outer surfaces of the fibrous material and matter to enhance release of the matter from the fibrous material.

9. A method for treating cotton fiber containing trash for the removal of said trash from the cotton fiber and wherein the cotton fiber and trash have a given moisture content extending to the outer surfaces thereof and a given temperature, the method comprising the steps of:

A. passing the cotton fiber containing said trash along a path of travel; and

B. directing a jet of a gas against the cotton fiber in the path of travel wherein said gas has a temperature sufficiently greater than said given temperature of the cotton fiber and trash sufficiently to reduce said given moisture content in said outer surfaces of the cotton fiber and trash to release the adhesive character of the moisture content for the removal of the trash from the cotton fiber.

10. The method of claim 9 wherein said passing is at a given velocity and said directing includes directing said jet of gas against the cotton fiber at a velocity substantially greater than the velocity of the cotton fiber passing along the path of travel and the method further includes resisting movement of the cotton fiber in said path of travel to attenuate said cotton fiber to expose more of the outer surfaces of the cotton fiber and trash to said jet of gas.

11. The method of claim 10 including passing the cotton fiber through a zone of greater temperature than said given temperature thereof subsequent to said directing to enhance said reduction of moisture content in the outer surfaces of the cotton fiber and trash.

12. An apparatus for treating fibrous material containing matter to be separated therefrom, the apparatus comprising a housing having a path of fluid movement therethrough; means for passing said fibrous material containing matter along said path through the housing; and means for releasing a gas having a temperature greater than that of the fibrous material and matter against the fibrous material and matter during passing thereof along said path to condition the fibrous material for release of the matter therefrom.

13. The apparatus of claim 12 including a member mounted in the housing for rotational movement and having portions extending therefrom into said path for engagement by the fibrous material and matter and means for rotating said member at a velocity less than the velocity of the fibrous material moving along said path thereby to resist movement of the fibrous material to attenuate the fibrous material for enhanced release of the matter therefrom.

14. The apparatus of claim 13 wherein said member has a substantially cylindrical configuration, the housing has a wall spaced from and substantially concentric to said member to define said path and said portions of the member are projections substantially radially extending from the member for passage in the direction of movement of the fibrous material in said path and in juxtaposition to said wall of the housing.

15. The apparatus of claim 14 wherein said releasing means includes a nozzle oriented to release said gas along a path between said member and said wall in spaced, substantially tangential relation to the member.

16. The apparatus of claim 15 wherein said nozzle has a passage through which said gas is released along said path and said passage is adjustable in size.

17. The apparatus of claim 16 wherein said wall is a first wall and said nozzle is formed by a second wall of the housing and a portion of said first wall of the housing with said passage defined therebetween and said portion of the first wall is movable toward and from the second wall to adjust the size of said passage of the nozzle.

18. The apparatus of claim 17 including a cam and cam follower linking said portion of the first wall and the housing operable selectively to move said portion of the first wall toward and from the second wall.

19. The apparatus of claim 18 wherein said gas is heated air, said releasing means includes a source of said heated air and the housing has a plenum disposed in receiving relation to said source of heated air and in releasing relation to said nozzle.

20. The apparatus of claim 19 wherein said first wall of the housing is a portion of the plenum disposed in heat transferring relation to said path through said first wall.

21. The apparatus of claim 13 wherein said rotating means is operable to rotate said member at a velocity of substantially about forty (40) revolutions to substantially about eighty (80) revolutions per minute and said gas releasing means is operable to release said gas against the fibrous material at a velocity of from substantially about eight (8) thousand feet per minute to substantially about twelve (12) thousand feet per minute.

22. The apparatus of claim 17 wherein said fibrous material is cotton fiber and the matter to be separated therefrom is trash, the housing is mounted substantially beneath a source of said fibrous material and the housing includes a trough interconnecting the source and said path for the receipt of said fibrous material therefrom.

* * * * *